US009173254B2

(12) United States Patent
Choi et al.

(10) Patent No.: US 9,173,254 B2
(45) Date of Patent: Oct. 27, 2015

(54) INFRARED RAY DETECTION DEVICE, HEATING COOKER, AND METHOD OF MEASURING TEMPERATURE OF COOLING CHAMBER OF HEATING COOKER

(75) Inventors: Jun hoe Choi, Suwon-si (KR); Yeon A. Hwang, Suwon-si (KR); Ki Hing Noh, Seoul (KR); Jeong Su Han, Suwon-si (KR); Ji Hoon Ha, Suwon-si (KR); Tae Gyoon Noh, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 866 days.

(21) Appl. No.: 13/289,520

(22) Filed: Nov. 4, 2011

(65) Prior Publication Data

US 2012/0114012 A1 May 10, 2012

(30) Foreign Application Priority Data

Nov. 5, 2010 (KR) ..... 10-2010-0109912
Nov. 3, 2011 (KR) ..... 10-2011-0113690

(51) Int. Cl.

| | |
|---|---|
| ***H05B 6/68*** | (2006.01) |
| ***H05B 6/64*** | (2006.01) |
| ***F24C 3/12*** | (2006.01) |
| ***F24C 7/08*** | (2006.01) |

(52) U.S. Cl.

CPC ..... *H05B 6/6455* (2013.01); *F24C 3/128* (2013.01); *F24C 7/085* (2013.01)

(58) Field of Classification Search

CPC ..... F24C 7/087; H05B 6/68
USPC ..... 374/121
See application file for complete search history.

(56) References Cited

U.S. PATENT DOCUMENTS 4,191,876 A 3/1980 Ohkubo et al.
4,286,134 A 8/1981 Nakata et al.
4,347,418 A * 8/1982 Nobue et al. ..... 219/711

(Continued)

FOREIGN PATENT DOCUMENTS

DE 10 2009 041 728 A1 6/2010
EP 0781072 A1 6/1997

(Continued)

OTHER PUBLICATIONS

U.S. Appl. No. 13/317,362, filed Oct. 17, 2011, Jun hoe Choi et al.

(Continued)

*Primary Examiner* — Lisa Caputo
*Assistant Examiner* — Jamel Williams
(74) *Attorney, Agent, or Firm* — Staas & Halsey LLP

(57) ABSTRACT

A heating cooker including an infrared ray detection device is disclosed. The heating cooker includes a body, an inner case disposed within the body, and provided therein with a cooking chamber to cook food, a detection hole formed at one side wall of the inner case, to allow an infrared ray generated in the cooking chamber to exit outwardly from the cooking chamber, a path change unit disposed in the vicinity of the detection hole, to change a path of the infrared ray passing through the detection hole, and an infrared sensor disposed to be spaced apart from the path change unit, to receive the infrared ray, the path of which has been changed. The path change unit is rotatable to enable the infrared sensor to receive infrared rays having different paths while being generated in different regions in the cooking chamber.

32 Claims, 16 Drawing Sheets

(56) References Cited

U.S. PATENT DOCUMENTS

| | | | | |
|---|---|---|---|---|
| 6,376,812 | B2 * | 4/2002 | Yamada et al. | 219/492 |
| 6,586,714 | B2 * | 7/2003 | Kawamura et al. | 219/711 |
| 6,630,655 | B2 * | 10/2003 | Fukunaga et al. | 219/711 |
| 8,360,633 | B2 * | 1/2013 | Luckhardt et al. | 374/121 |
| 2003/0047559 | A1 | 3/2003 | Watanabe et al. | |
| 2004/0057493 | A1 | 3/2004 | Ishikawa et al. | |
| 2005/0150519 | A1 | 7/2005 | Keppler et al. | |
| 2010/0128755 | A1 | 5/2010 | Luckhardt et al. | |
| 2012/0111204 | A1 * | 5/2012 | Choi et al. | 99/331 |

FOREIGN PATENT DOCUMENTS

| | | | |
|---|---|---|---|
| EP | 1 806 086 | A2 | 7/2007 |
| KR | 1996-0003501 | | 1/1996 |
| KR | 100129239 | | 11/1997 |
| KR | 10-1998-077169 | | 11/1998 |
| KR | 10-2008-0100554 | | 11/2008 |
| WO | 2007/137234 | A2 | 11/2007 |

OTHER PUBLICATIONS

European Search Report dated Nov. 22, 2012 issued in corresponding European Patent Application 12181180.6.

Extended European Search Report mailed Dec. 22, 2014 in related European Application No. 11187912.8.

Office Action mailed Feb. 28, 2015 in corresponding Chinese Patent Application No. 201110352864.6.

* cited by examiner

INFRARED RAY DETECTION DEVICE, HEATING COOKER, AND METHOD OF MEASURING TEMPERATURE OF COOLING CHAMBER OF HEATING COOKER

CROSS-REFERENCE TO RELATED APPLICATION

This application claims the benefit of Korean Patent Application Nos. P2010-109912 and P2011-113690, respectively filed on Nov. 5, 2010 and Nov. 3, 2011 in the Korean Intellectual Property Office, the disclosures of which are incorporated herein by reference.

BACKGROUND

1. Field

Embodiments of the present invention relate to a heating cooker including an infrared ray detection device.

2. Description of the Related Art

A heating cooker is a device for cooking food by increasing the temperature of the food. Generally, such a heating cooker includes a microwave oven, in which food is irradiated with microwaves, and a gas oven and an electric oven, in which heat is directly applied to food. The microwave oven is a device in which microwaves generated from a magnetron are irradiated onto food, to generate frictional heat in accordance with parallel motion of water molecules contained in the food, and thus to cook the food using the frictional heat.

The cooked state of food may be checked based on a measured temperature of the food. However, it is difficult to directly measure the temperature of the food during cooking. To this end, the temperature of food is measured using a method in which the intensity of infrared rays generated from the food is measured, and the temperature of food is calculated based on the measured intensity of infrared rays. An infrared sensor is generally used for measurement of the intensity of infrared rays. The infrared sensor is arranged in the vicinity of a detection hole formed at a cooking chamber to receive a light receiving portion of the infrared sensor, which receives an infrared ray, such that the light receiving portion is exposed to the cooking chamber.

However, the light receiving portion may be contaminated by oil vapor or water vapor generated from food because the light receiving portion of the infrared sensor is exposed to the cooking chamber. In the case of a microwave oven, microwaves irradiated into the cooking chamber may reach the light receiving portion, thereby degrading the reliability of measurement results.

SUMMARY

Therefore, it is an aspect of the present invention to provide a heating cooker including an infrared detection device using a mirror.

Additional aspects of the invention will be set forth in part in the description which follows and, in part, will be obvious from the description, or may be learned by practice of the invention.

In accordance with one aspect of the present invention, a heating cooker includes a body, an inner case disposed within the body, and provided therein with a cooking chamber to cook food, a detection hole formed at one side wall of the inner case, to allow an infrared ray generated in the cooking chamber to exit outwardly from the cooking chamber, a path change unit disposed in the vicinity of the detection hole, to change a path of the infrared ray passing through the detection hole, and an infrared sensor disposed to be spaced apart from the path change unit, to receive the infrared ray, the path of which has been changed, wherein the path change unit is rotatable to enable the infrared sensor to receive infrared rays having different paths while being generated in different regions in the cooking chamber.

A distance, by which the infrared sensor is spaced apart from the path change unit, may be kept constant during rotation of the path change unit.

The detection hole may be formed at one of left and right side walls of the inner case, and may be disposed closer to a top wall of the inner case than to the bottom wall of the inner case.

The path change unit may include a mirror to reflect an infrared ray, thereby changing a path of the infrared ray.

The heating cooker may further include a driver connected to the path change unit, to rotate the path change unit.

The driver may include a stepper motor to rotate the path change unit stepwise by a predetermined angle.

The distance, by which the infrared sensor is spaced apart from the path change unit, may be 20 mm or less.

The infrared sensor may include a light receiving portion disposed to face the path change unit, to receive an infrared ray. The path change unit may rotate about a virtual rotation axis perpendicular to the light receiving portion.

Infrared rays generated in regions between opposite edges of a bottom surface of the cooking chamber may be received by the infrared sensor during rotation of the path change unit.

The infrared sensor may include a light receiving portion disposed to face the path change unit, to receive an infrared ray. The path change unit may rotate about a rotation axis perpendicular to a virtual axis, which is perpendicular to the light receiving portion.

In accordance with another aspect of the present invention, an infrared ray detection device includes a path change unit to change a path of an infrared ray, and an infrared sensor disposed to be spaced apart from the path change unit, to receive the infrared ray, the path of which has been changed, wherein the path change unit is rotatable to enable the infrared sensor to receive infrared rays having different paths.

A distance, by which the infrared sensor is spaced apart from the path change unit, may be kept constant during rotation of the path change unit.

The distance, by which the infrared sensor is spaced apart from the path change unit, may be 20 mm or less.

The infrared sensor may include a light receiving portion disposed to face the path change unit. The path change unit may rotate about a virtual axis perpendicular to the light receiving portion.

The infrared sensor may include a light receiving portion disposed to face the path change unit, to receive an infrared ray. The path change unit may rotate about a rotation axis perpendicular to a virtual axis, which is perpendicular to the light receiving portion while passing though the light receiving portion.

In accordance with another aspect of the present invention, a heating cooker includes a body, an inner case disposed within the body, and provided therein with a cooking chamber to cook food, a detection hole formed at one side wall of the inner case, to allow an infrared ray generated in the cooking chamber to exit outwardly from the cooking chamber, a path change unit disposed in the vicinity of the detection hole, to change a path of the infrared ray passing through the detection hole, and an infrared sensor disposed to be spaced apart from the path change unit, to receive the infrared ray, the path of which has been changed, wherein the path change unit is rotatable to enable the infrared sensor to receive infrared rays having different paths while being generated in different regions in the cooking chamber, and wherein the path change unit rotates about a virtual rotation axis perpendicular to the light receiving portion.

In accordance with another aspect of the present invention, a method for measuring a cooking chamber temperature in a heating cooker including a cooking chamber, a path change unit disposed outside the cooking chamber, the path change unit being rotatable to change a path of an infrared ray generated in the cooking chamber, and an infrared sensor to receive the infrared ray, the path of which has been changed, includes rotating the path change unit to a first position, to enable the infrared sensor to receive infrared rays generated in a first region on a bottom surface of the cooking chamber, rotating the path change unit to a second position, to enable the infrared sensor to receive infrared rays generated in a second region on the bottom surface of the cooking chamber, measuring intensities of the infrared rays received by the infrared sensor after being generated in the first and second regions, and calculating temperatures of the first and second regions, based on the measured infrared ray intensities.

In accordance with another aspect of the present invention, a heating cooker includes a body, an inner case disposed within the body, and provided therein with a cooking chamber to cook food, a detection hole formed at one side wall of the inner case, to allow an infrared ray generated in the cooking chamber to exit outwardly from the cooking chamber, an infrared sensor to detect an infrared ray, thereby measuring an internal temperature of the cooking chamber, and a path change unit disposed in the vicinity of the detection hole, to change a path of the infrared ray passing through the detection hole, thereby causing the infrared ray to be directed to the infrared sensor, wherein the path change unit includes a mirror having a curvature to enable the infrared sensor to detect the infrared ray generated in the cooking chamber.

The mirror may be a convex mirror.

The mirror may be a concave mirror.

In accordance with another aspect of the present invention, a heating cooker includes a body, an inner case disposed within the body, and provided therein with a cooking chamber to cook food, a detection hole formed at one side wall of the inner case, to allow an infrared ray generated in the cooking chamber to exit outwardly from the cooking chamber, an infrared sensor to detect an infrared ray, thereby measuring an internal temperature of the cooking chamber, and an infrared ray convergence unit disposed in the vicinity of the detection hole, the infrared ray convergence unit having a curvature to cause the infrared ray generated in the cooking chamber to be converged toward the infrared sensor.

The infrared ray convergence unit may include a lens having a curvature.

The lens may include a convex lens.

The lens may include a concave lens.

The infrared sensor may include a light receiving portion disposed in parallel to the lens to receive an infrared ray.

The lens and the light receiving portion may be disposed to be inclined with respect to one of left and right walls of the inner case where the detection hole is formed.

The lens and the infrared sensor may be integrally formed.

The infrared sensor may include a light receiving portion to receive an infrared ray. The lens may be mounted to an outer surface of the light receiving portion.

The infrared ray convergence unit may include a mirror having a curvature.

BRIEF DESCRIPTION OF THE DRAWINGS

These and/or other aspects of the invention will become apparent and more readily appreciated from the following description of the embodiments, taken in conjunction with the accompanying drawings of which.

DESCRIPTION OF EMBODIMENTS

Hereinafter, embodiments of the present invention will be described with reference to the accompanying drawings.

Embodiments of the present invention are applicable to any heating cooker. The following description will be given in conjunction with, for example, a microwave oven.

Figure 1:
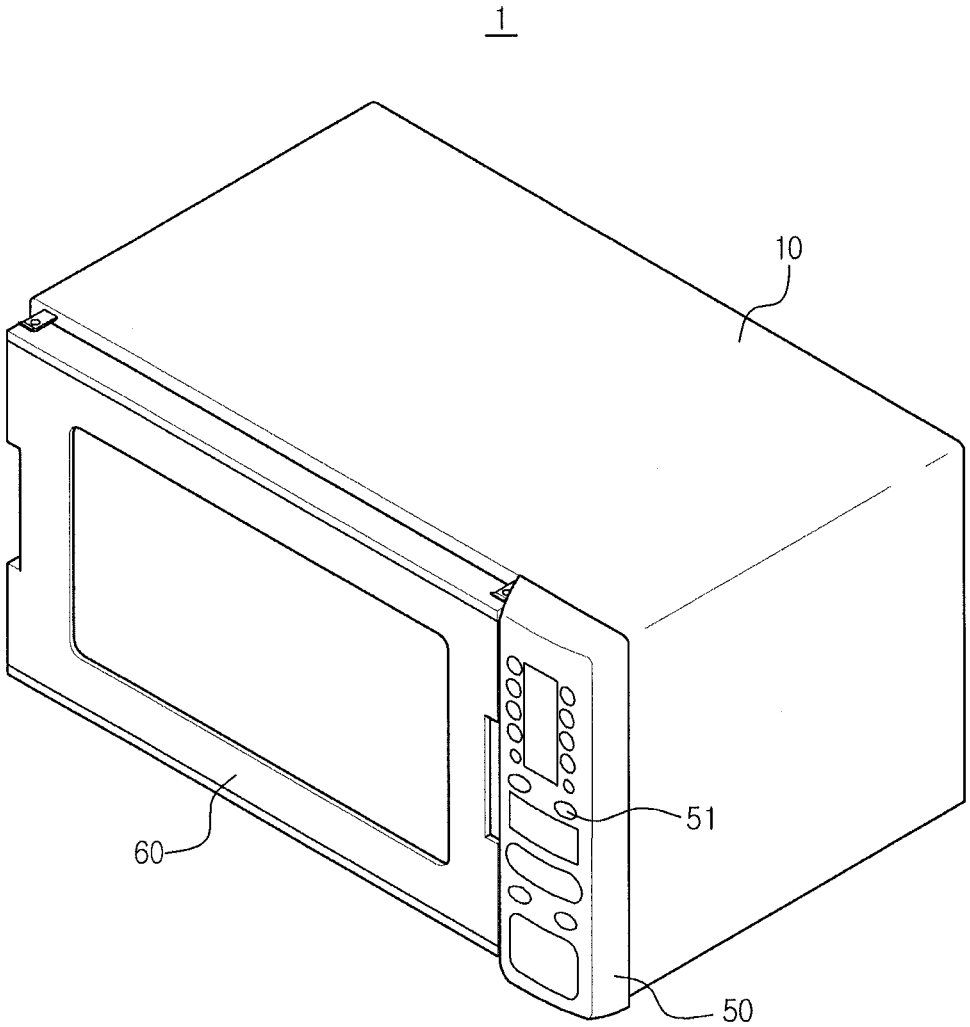
FIG. 1 is a perspective view illustrating a microwave oven according to an exemplary embodiment.
Figure 2:
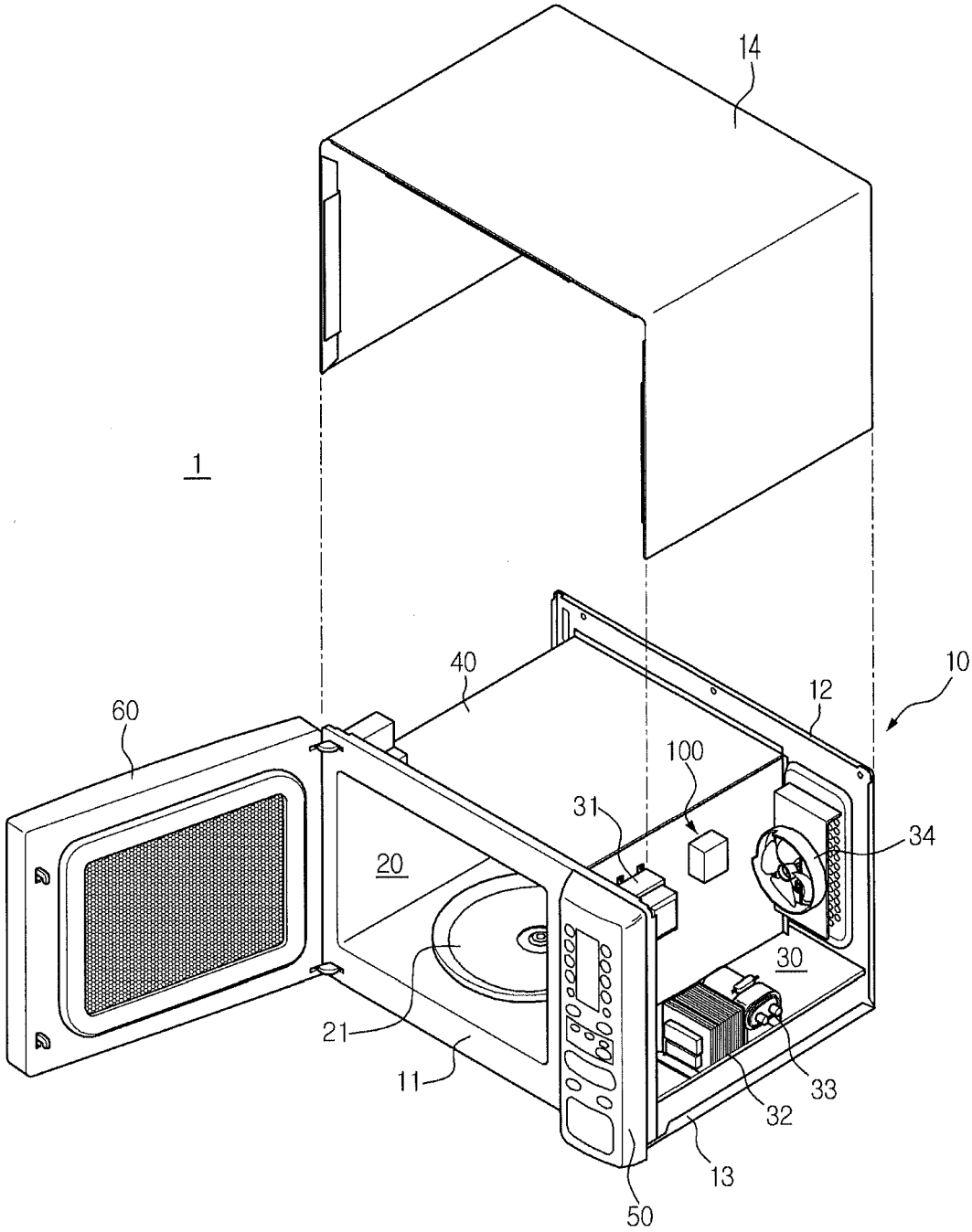
FIG. 2 is an exploded perspective view illustrating essential configurations of the microwave oven shown in FIG. 1.

FIG. 1 is a perspective view illustrating a microwave oven according to an exemplary embodiment. FIG. 2 is an exploded perspective view thereof.

As shown in FIGS. 1 and 2, the microwave oven, which is designated by reference numeral 1, includes a body 10 to define an outer appearance of the microwave oven 1. The body 10 includes a front plate 11 and a rear plate 12, which define a front surface and a rear surface, respectively, a bottom plate 13 to define a bottom surface, and a cover 14 to define both side surfaces and a top surface.

An inner case 40 is provided in the body 10. The inner case 40 has a rectangular parallelepiped shape opened at a front side thereof while having an inner surface to define an inner space as a cooking chamber 20, and an outer surface to define an outer space as an electric element chamber 30. A door 60 is hinged to the front plate 11, to open or close the cooking chamber 20. An operating panel 50, which is provided with a plurality of operating buttons 51 for operation of the microwave oven 1, is also provided at the front plate 11.

In the electric element chamber 30, which is provided at a right side of the cooking chamber 20, a magnetron 31 is disposed to generate microwaves to be supplied to the cooking chamber 20. A high-voltage transformer 32 and a high-voltage capacitor 33 are also disposed in the electric element chamber 30, to apply high voltage to the magnetron 31. A cooling fan 34 is also disposed in the electric element chamber 30, to cool the elements disposed in the electric element chamber 30. A tray 21, upon which food is placed, is installed on the bottom of the cooking chamber 20 within the cooking chamber 20. A waveguide (not shown) is also installed in the cooking chamber 20, to guide the microwaves emitted from the magnetron 31 to the cooking chamber 20.

When microwaves are irradiated into the cooking chamber 20 by driving the microwave oven 1 under the condition that food is placed on the tray 21, the molecular arrangement of moisture contained in the food is repeatedly changed by the microwave oven, so that frictional heat is generated among the molecules of the moisture, thereby cooking the food disposed in the cooking chamber 20.

It may be possible to check the cooled state of the food by measuring the temperature of the food. The temperature of the food may be calculated by measuring the intensity of infrared rays generated from the food. To this end, the microwave oven 1 includes an infrared ray detection device 100 to measure the intensity of infrared rays generated in the cooking chamber 20.

Figure 3:
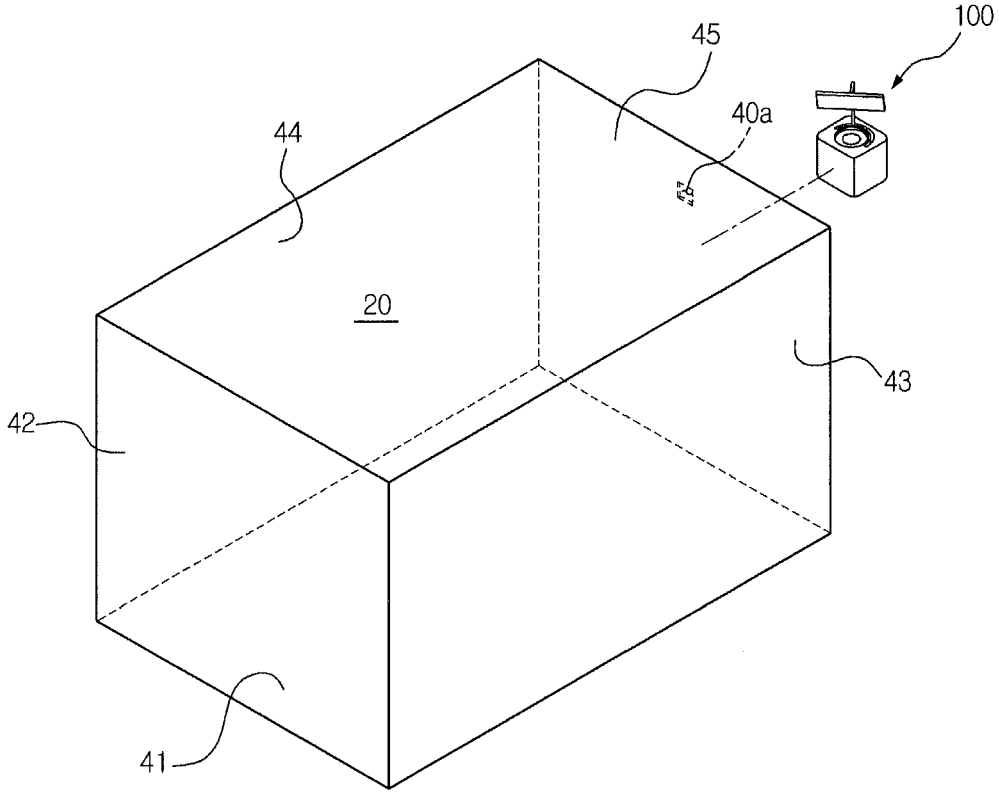
FIG. 3 is a view illustrating the infrared ray detection device mounted in the cooking chamber of the microwave oven shown in FIG. 1.
Figure 4:
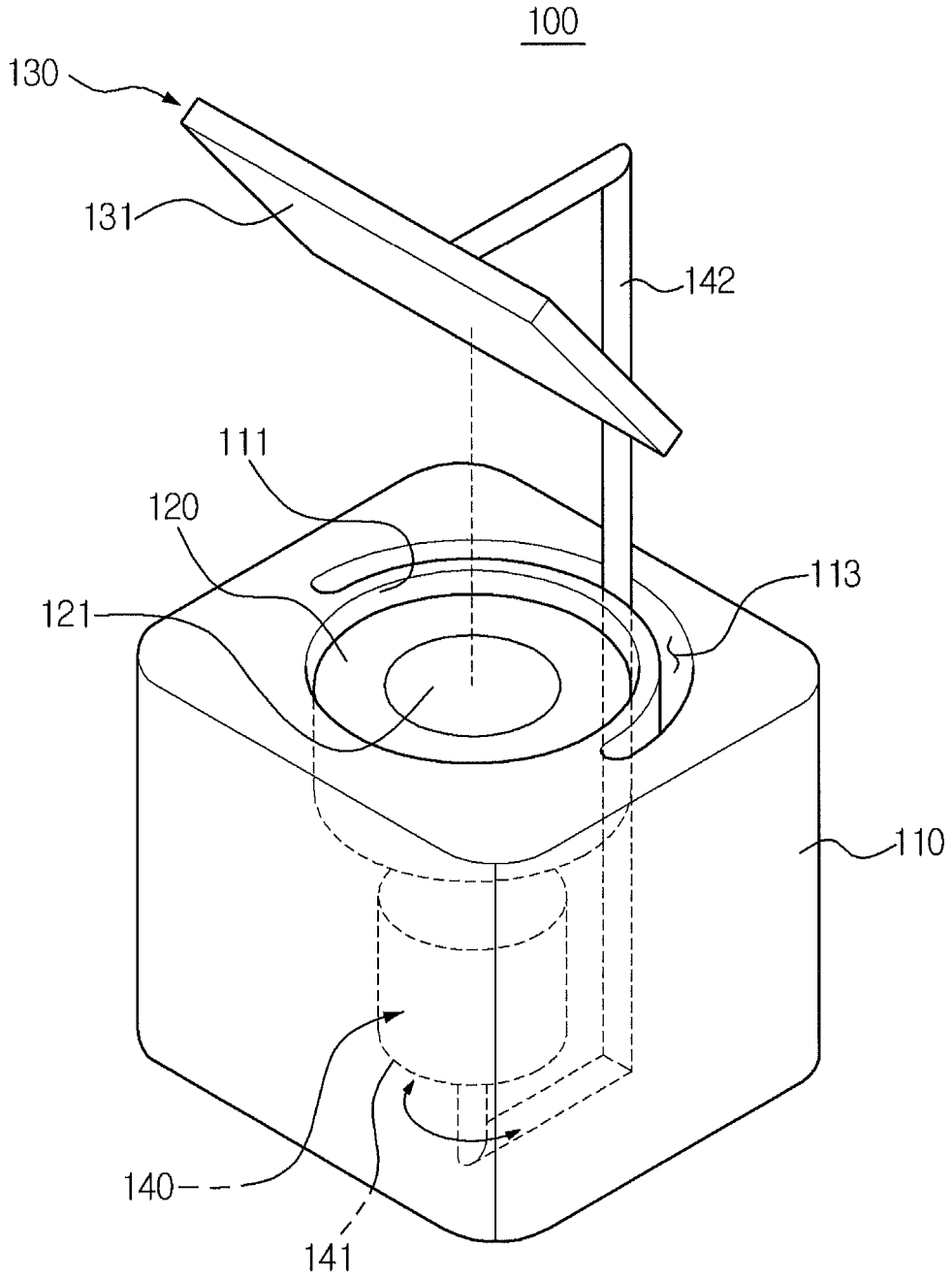
FIG. 4 is a perspective view illustrating the infrared ray detection device shown in FIG. 3.
Figure 5:
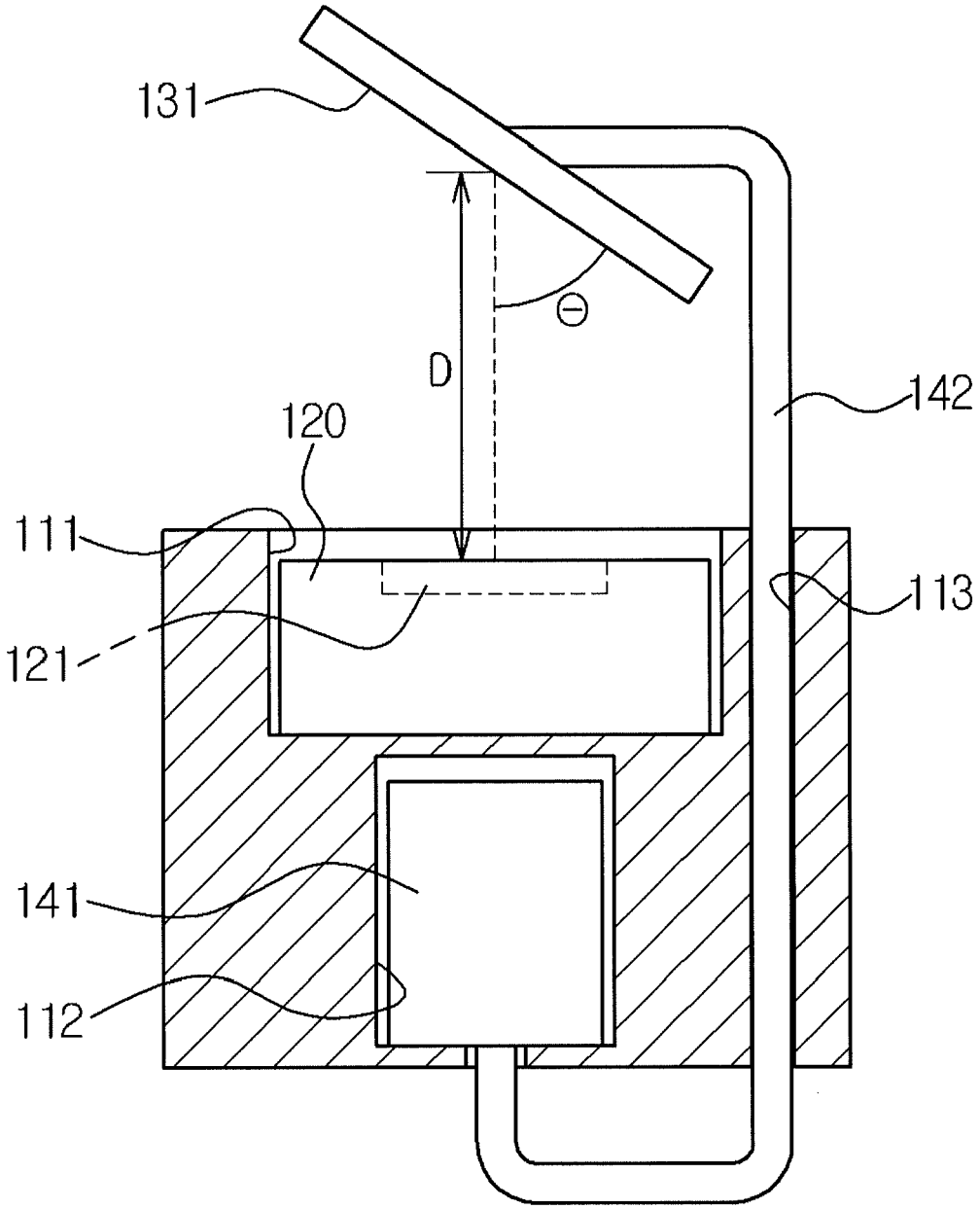
FIG. 5 is a sectional view illustrating the infrared ray detection device shown in FIG. 4.

FIG. 3 is a view illustrating the infrared ray detection device mounted in the cooking chamber of the microwave oven shown in FIG. 1. FIG. 4 is a perspective view illustrating the infrared ray detection device shown in FIG. 3. FIG. 5 is a sectional view illustrating the infrared ray detection device shown in FIG. 4.

As shown in FIGS. 3 to 5, the infrared ray detection device 100 is disposed outside the inner case 40. A detection hole 40*a* is formed at the inner case 40, to allow an infrared ray generated in the cooking chamber 20 to exit outwardly from the cooking chamber 20. The infrared ray detection device 100 is disposed in the vicinity of the detection hole 40*a*, to receive infrared rays emerging from the detection hole 40*a*. The infrared ray detection device 100 may be fixed to the inner case 40 by fasteners such as screws.

The detection hole 40*a* is formed at a right wall 43 of the inner case 40. Of course, the position of the detection hole 40*a* is not limited to the above-described position. For example, the detection hole 40*a* may be formed at a left wall 42 of the inner case 40. a rear wall 44 of the inner case 40, or a top wall 45 of the inner case 40. Since the infrared ray detection device 100 is disposed in the vicinity of the detection hole 40*a*, the position of the detection hole 40*a* is restricted by whether it is possible to secure a space where the infrared ray detection device 100 is disposed.

When the detection hole 40*a* is formed at one of the left wall 42, right wall 43, and rear wall 44 of the inner case 40, it is positioned to be closer to the bottom wall 41 of the inner case 40. Since food is disposed in a lower portion of the cooking chamber 20, it may be desirable to from the detection port 40*a* to communicate with an upper portion of the cooking chamber 20 in order to allow an infrared ray generated throughout the entirety of the lower portion of the cooking chamber 20 to reach the infrared ray detection device 100 after passing through the detection hole 40*a*.

The detection hole 40*a* may have a square shape. Of course, the detection hole 40*a* may have a circular or oval shape as well.

The infrared ray detection device 100 includes a housing 110, an infrared sensor 120, a path change unit 130, and a driver 140.

The housing 110 defines an outer appearance of the infrared ray detection device 100. The housing 110 is formed with a sensor mounting portion 111, at which the infrared sensor 120 is mounted. The sensor mounting portion 11 is upwardly opened, and has a shape corresponding to the infrared sensor 120. A driver mounting portion 112, at which the driver 140 is mounted, is also formed at the housing 110. The driver mounting portion 112 is arranged beneath the sensor mounting portion 111. A rotation guide groove 113 is formed at the housing 110, to guide rotation of a connecting member 142, which will be described later.

The infrared sensor 120 has a cylindrical shape, and is provided, at a top surface thereof, with a light receiving portion 121. The infrared sensor 120 is mounted to the sensor mounting portion 111 such that the light receiving portion 121 is positioned to be directed upward. An infrared ray detection element (not shown) is disposed beneath the light receiving portion 121. The infrared ray detection element (not shown) receives infrared rays, and generates a detection output corresponding to the intensity of the received infrared rays. A plurality of infrared ray detection elements (not shown) may be provided to receive infrared rays generated at a plurality of regions in the cooking chamber 20 as shown in FIG. 3.

The light receiving portion 121 of the infrared sensor 120 is arranged to be spaced apart from the detection hole 40*a* formed at the inner case 40 shown in FIG. 3 by a certain distance in a longitudinal direction of the outer surface of the inner case 40 such that the light receiving portion 121 is not aligned with the detection hole 40*a*. Accordingly, the field of vision of the light receiving portion 121 is directed to the detection hole 40*a*. That is, the infrared rays emerging from the detection hole 40*a* after being generated in the cooking chamber 20 cannot reach the light receiving portion 121, so long as the path of the infrared rays is not changed. In other words, the light receiving portion 121 is not positioned on the path of the infrared rays emerging from the detection hole 40*a*.

Since oil vapor or water vapor generated during cooking may pass through the detection hole 40*a*, it may be desirable to arrange the infrared ray detection device 100 such that the light receiving portion 121 is disposed below the detection hole 40*a* in order to prevent oil vapor or water vapor from contaminating the light receiving portion 121.

The path change unit 130 changes the path of the infrared rays passing through the detection hole 40*a* of the inner case 40, to allow the infrared rays to be received by the infrared sensor 120. To this end, the path change unit 130 is disposed on the path of the infrared rays passing through the detection hole 40*a*. Also, the path change unit 130 is disposed over the infrared sensor 120 in order to allow the infrared rays to be received by the light receiving portion 121 of the infrared sensor 120 after the paths thereof are changed. The path change unit 130 may reflect or refract the infrared rays in order to change the path of the infrared rays, which travel in a straight line.

The path change unit 130 may include a mirror 131 to reflect infrared rays, which are incident upon the mirror 121 at a certain angle of incidence. The mirror 131 may be a planer mirror having an angle of incidence and a reflection angle, which are equal. Alternatively, the mirror 131 may be a curved mirror having a certain curvature.

The mirror 131 is arranged to be inclined at a certain angle with respect to the infrared sensor 120. That is, the mirror 131 forms a certain angle θ with respect to a virtual axis extending upwardly from the light receiving portion 121 of the infrared sensor 120 by a certain distance D while being perpendicular to the light receiving portion 121. The angle θ is kept constant during rotation of the path change unit 130 around the infrared sensor 120.

The mirror 131 is arranged such that the virtual axis, which extends upwardly from a center of the light receiving portion 121 of the infrared sensor 120 while being perpendicular to the light receiving portion 121, passes through a region around the center of the mirror 131. An infrared ray, which passes through the detection hole 40*a*, is reflected from the region around the center of the mirror 131, and then reaches the light receiving portion 121.

The distance D is determined by the size of the light receiving portion 121 of the infrared sensor 120. This is because infrared rays generated in a plurality of regions should be completely received by the light receiving portion 121 after the paths thereof are changed by the path change unit 130. When the area of the light receiving portion 121 is great, infrared rays can completely reach the light receiving portion 121 even when the distance D is more or less long. However, when the area of the light receiving portion 121 is small, a portion of the infrared rays may not reach the light receiving portion 121. When a general size of the infrared sensor 120 is taken into consideration, the distance D between the center of the path change unit 130 and the light receiving portion 121 of the infrared sensor 120 is desirably 20 mm or less.

The driver 140 rotates the path change unit 130 around the infrared sensor 120. To this end, the driver 140 includes a connecting member 142, and the connecting member 142 connects an output of the driver 140 to the path change unit 130. An arc-shaped rotation guide slot 113 is formed to guide rotation of the connecting member 142. The connecting member 142 rotates along the rotation guide slot 113.

The driver 140 may include a stepper motor 141 to rotate stepwise. The stepper motor 141 rotates the path change unit 130 stepwise so that infrared rays generated throughout the entirety of the bottom surface of the cooking chamber 20 are completely received by the infrared sensor 120.

As the driver 140 rotates the path change unit 130, the entirety of the bottom surface of the cooking chamber 20 from the left side to the right side or vice versa comes within the field of vision of the path change unit 130, when viewing the cooking chamber 20 through the detection hole 40*a* from the side of the infrared ray detection device 100. Accordingly, the paths of the infrared rays generated throughout the entirety of the bottom surface of the cooking chamber 20 are changed by the path change unit 130, so that the infrared rays are completely received by the infrared sensor 120.

Figure 6:
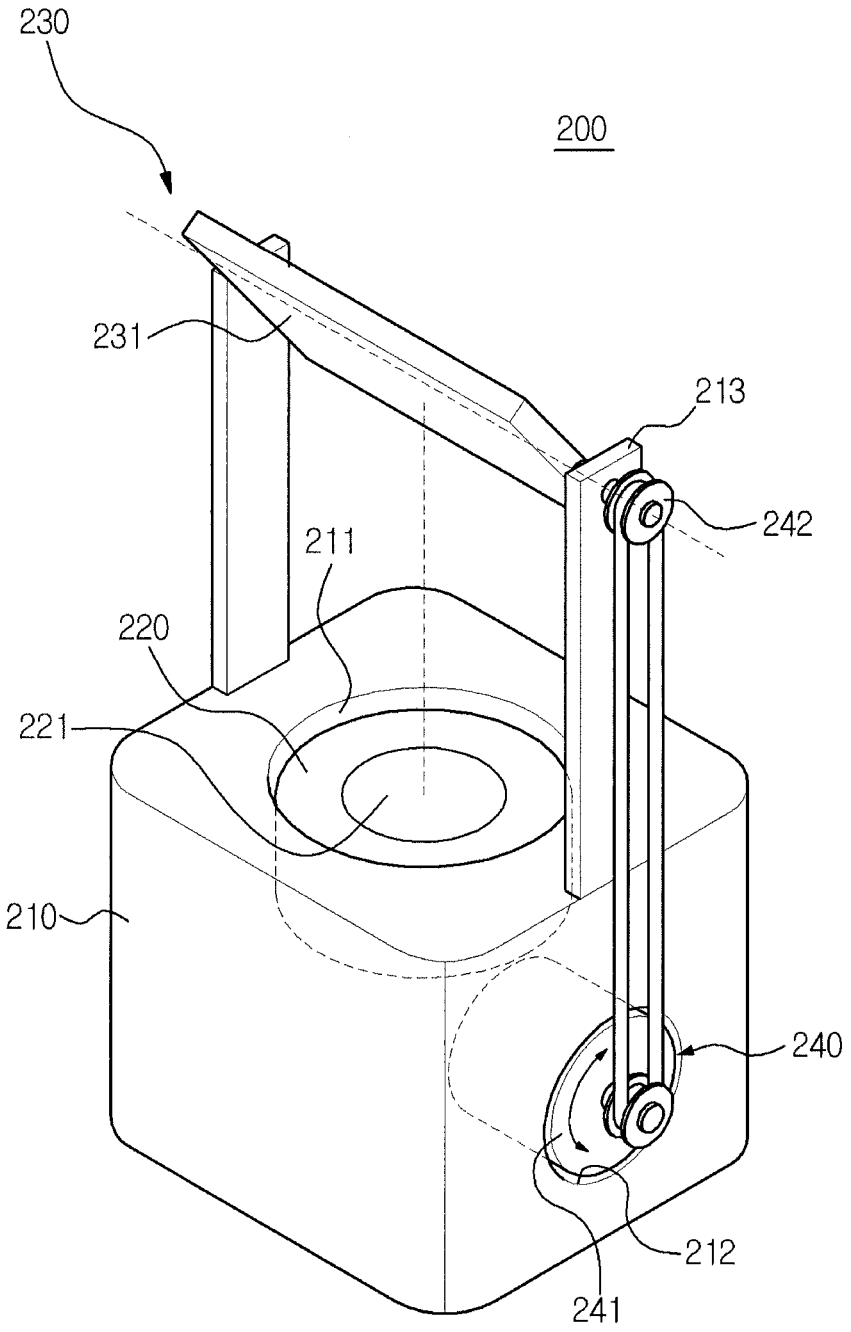
FIG. 6 is a perspective view illustrating an infrared ray detection device according to another embodiment.

FIG. 6 is a perspective view illustrating an infrared ray detection device according to another embodiment.

As shown in FIG. 6, the infrared ray detection device, which is designated by reference numeral "200", includes a housing 210, an infrared sensor 220, a path change unit 230, and a driver 240. The infrared sensor 220 is identical to the infrared sensor 120 shown in FIGS. 4 and 5.

The housing 210 defines an outer appearance of the infrared ray detection device 200. The housing 210 is formed with a sensor mounting portion 211, at which the infrared sensor 220 is mounted. A driver mounting portion 212, at which the driver 240 is mounted, is also formed at the housing 210. The driver mounting portion 212 is formed at one side surface of the housing 210.

The housing 210 is also formed with support portions 213 extending upwardly to support the path change unit 230. The support portions 213 support opposite sides of the path change unit 230, respectively. The path change unit 230 is rotatably coupled to the support portions 213.

The path change unit 230 is disposed on the path of an infrared ray passing through the detection hole 40*a* of the inner case 40 shown in FIG. 3. The path change unit 230 reflects or refracts the infrared ray in order to change the path thereof. The path change unit 230 may be a mirror having an angle of incidence and a reflection angle, which are equal.

The path change unit 230 is arranged such that a virtual axis, which extends upwardly from a center of a light receiving portion 221 included in the infrared sensor 220 while being perpendicular to the light receiving portion 221, passes through a region around the center of the path change unit 230. An infrared ray, which passes through the detection hole 40*a*, is reflected from the region around the center of the path change unit 230, and then reaches the light receiving portion 221.

The path change unit 230 is arranged to be spaced apart from the infrared sensor 220 by a certain distance. Similarly to the path change unit 130 shown in FIGS. 4 and 5, the distance is determined by the size of the light receiving portion 221 of the infrared sensor 220. When a general size of the infrared sensor 220 is taken into consideration, the distance between a rotation axis of the path change unit 230 and the light receiving portion 221 of the infrared sensor 220 is desirably 20 mm or less.

The rotation axis of the path change unit 230 is normal to the virtual axis extending upwardly while being perpendicular to the light receiving portion 221 of the infrared sensor 220. Accordingly, the angle formed between a reflection surface of the path change unit 230 and the virtual axis extending upwardly while being perpendicular to the light receiving portion 221 of the infrared sensor 220 is changed in accordance with rotation of the path change unit 230.

The driver 240 rotates the path change unit 230 about the rotation axis of the path change unit 230. The driver 240 includes a power transmission 242, which connects an output of the driver 240 to the rotation axis of the path change unit 230. The power transmission 242 may include a wire and a pulley.

The driver 240 may include a stepper motor 241 to rotate stepwise. The stepper motor 241 stepwise rotates the path change unit 230 so that infrared rays generated throughout the entirety of the bottom surface of the cooking chamber 20 are completely received by the infrared sensor 220.

As the driver 240 rotates the path change unit 230, the entirety of the bottom surface of the cooking chamber 20 from the left side to the right side or vice versa comes within the field of vision of the path change unit 230, when viewing the cooking chamber 20 through the detection hole 40*a* from the side of the infrared ray detection device 200. Accordingly, the infrared rays generated throughout the entirety of the bottom surface of the cooking chamber 20 are completely received by the infrared sensor 220. When the path change unit 230 is rotated N° under the condition that the infrared ray paths, which are changed by the path change unit 230, are fixed, the field of vision directed to the cooking chamber 20 is shifted by a distance corresponding to two times of N°, namely, 2N°.

Figure 7:
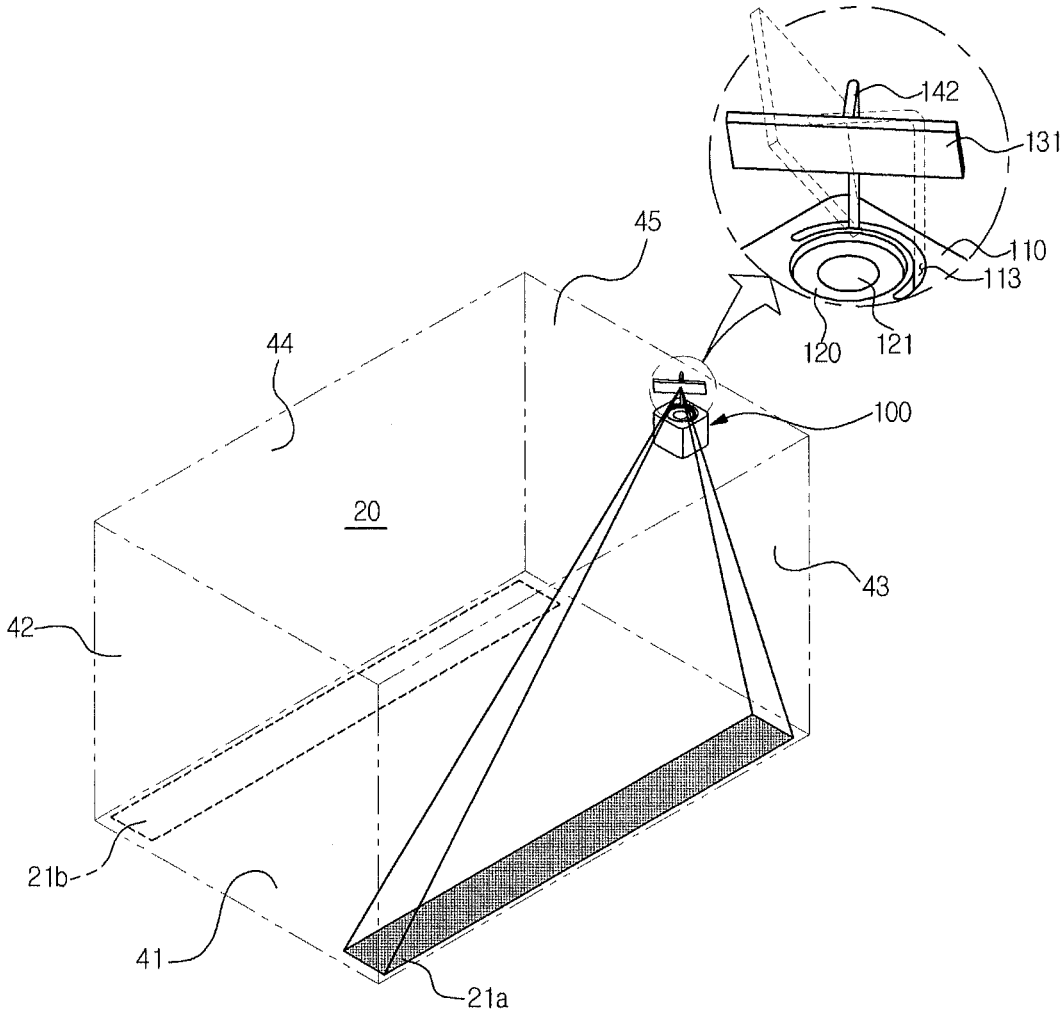
FIG. 7 is a view illustrating operation of the infrared ray detection device shown in FIG. 1.

FIG. 7 is a view illustrating operation of the infrared ray detection device shown in FIG. 1.

Referring to FIG. 7, when viewing the cooking chamber 20 from the side of the infrared ray detection device 100, the region positioned at a left edge side of the bottom surface of the cooking chamber 20 in a width direction of the cooking chamber 20 is a first region 21*a*, and the region positioned at a right edge side of the bottom surface of the cooking chamber 20 is a second region 21*b*. Also, the position of the mirror 131 indicated by a solid line in an enlarged view of FIG. 7 is a first position. When the mirror 131 is positioned at the first position, infrared rays generated in the first region 21*a* reach the light receiving portion 121 of the infrared sensor 120 after the paths thereof are changed by the mirror 131. On the other hand, the position of the mirror 131 indicated by a dotted line in the enlarged view of FIG. 7 is a second position. When the mirror 131 is positioned at the second position, infrared rays generated in the second region 21*b* reach the light receiving portion 121 of the infrared sensor 120 after the paths thereof are changed by the mirror 131.

Each of the first and second regions 21*a* and 21*b* includes a plurality of small regions. Infrared rays generated in the small regions are received by a plurality of infrared ray detection elements (not shown) arranged within the infrared sensor 120.

When the mirror 131 is positioned at the first position, infrared rays generated in the first region 21*a* are received by the infrared sensor 120 which, in turn, measures the intensity of the received infrared rays. Based on the measured infrared ray intensity, it may be possible to calculate the temperature of the first region 21*a*. The small regions in the first region 21*a* may have different temperatures.

After measurement of the intensity of the infrared rays generated in the first region 21*a*, the mirror 131 is rotated about a rotation axis thereof by a predetermined angle. The rotation of the mirror 131 and the infrared ray reception of the infrared sensor 120 are repeated until the mirror 131 reaches the second position and measures the intensity of infrared rays generated in the second region 21*b*.

After the measurement of the intensity of infrared rays is completed for all regions from the first region 21*a* to the second region 21*b*, it may be possible to calculate the temperature distribution of the entirety of the bottom surface of the cooking chamber 20.

Figure 8:
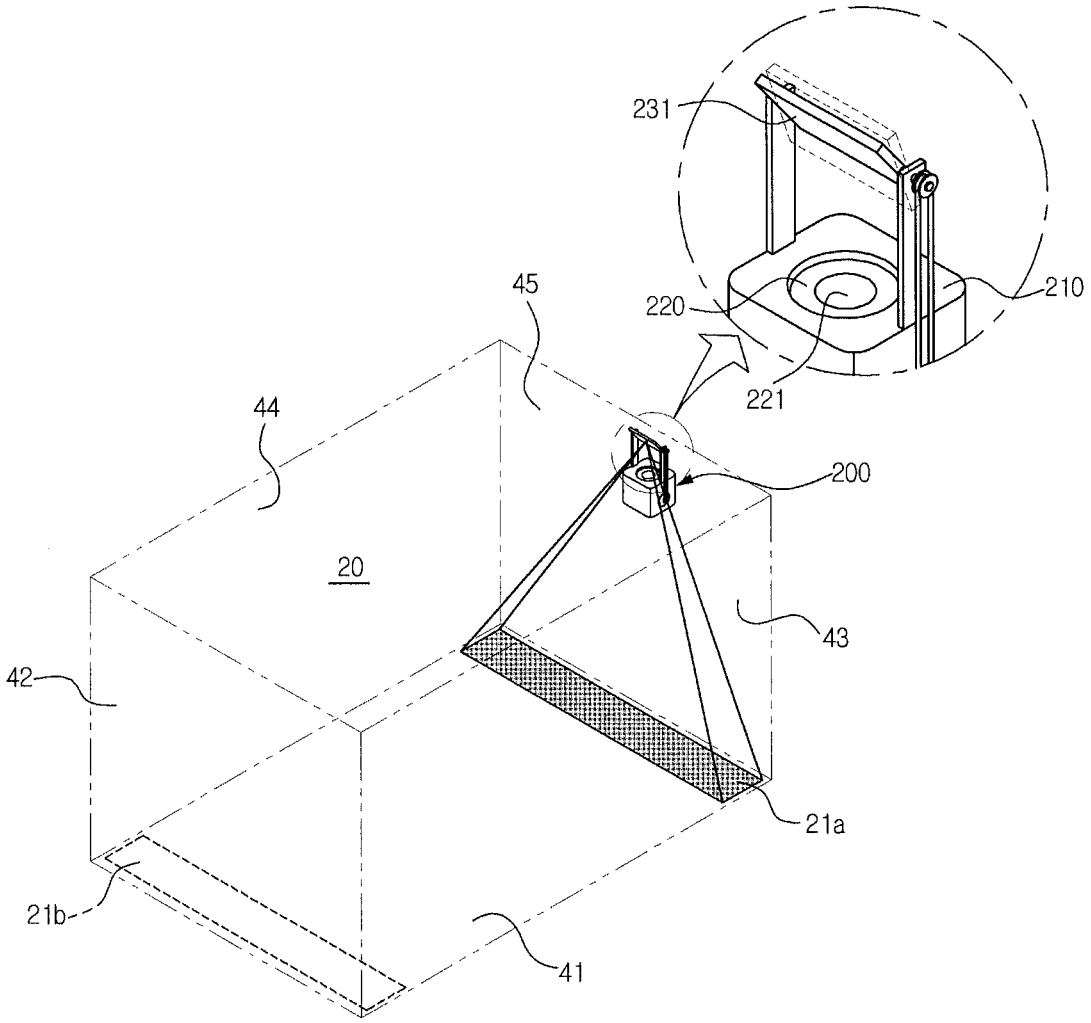
FIG. 8 is a view illustrating operation of the infrared ray detection device shown in FIG. 6.

FIG. 8 is a view illustrating operation of the infrared ray detection device shown in FIG. 6.

Referring to FIG. 8, when viewing the cooking chamber 20 from the side of the infrared ray detection device 200, the region positioned at an edge side of the bottom surface of the cooking chamber 20 toward the infrared ray detection device 200 in a longitudinal direction of the cooking chamber 20 is a first region 21*a*, and the region positioned at an edge side of the bottom surface of the cooking chamber 20 opposite the infrared ray detection device 200 is a second region 21*b*. Also, the position of the mirror 231 indicated by a solid line in an enlarged view of FIG. 8 is a first position. When the mirror 231 is positioned at the first position, infrared rays generated in the first region 21*a* reach the light receiving portion 221 of the infrared sensor 220 after the paths thereof are changed by the mirror 231. On the other hand, the position of the mirror 231 indicated by a dotted line in the enlarged view of FIG. 8 is a second position. When the mirror 231 is positioned at the second position, infrared rays generated in the second region 21*b* reach the light receiving portion 221 of the infrared sensor 220 after the paths thereof are changed by the mirror 231.

Each of the first and second regions 21*a* and 21*b* includes a plurality of small regions. Infrared rays generated in the small regions are received by a plurality of infrared ray detection elements (not shown) arranged within the infrared sensor 220.

When the mirror 231 is positioned at the first position, infrared rays generated in the first region 21*a* are received by the infrared sensor 220 which, in turn, measures the intensity of the received infrared rays. Based on the measured infrared ray intensity, it may be possible to calculate the temperature of the first region 21*a*. The small regions in the first region 21*a* may have different temperatures.

After measurement of the intensity of the infrared rays generated in the first region 21*a*, the mirror 231 is rotated about a rotation axis thereof by a predetermined angle. The rotation of the mirror 231 and the infrared ray reception of the infrared sensor 220 are repeated until the mirror 231 reaches the second position and measures the intensity of infrared rays generated in the second region 21*b*.

After the measurement of the intensity of infrared rays is completed for all regions from the first region 21*a* to the second region 21*b*, it may be possible to calculate the temperature distribution of the entirety of the bottom surface of the cooking chamber 20.

Figure 9:
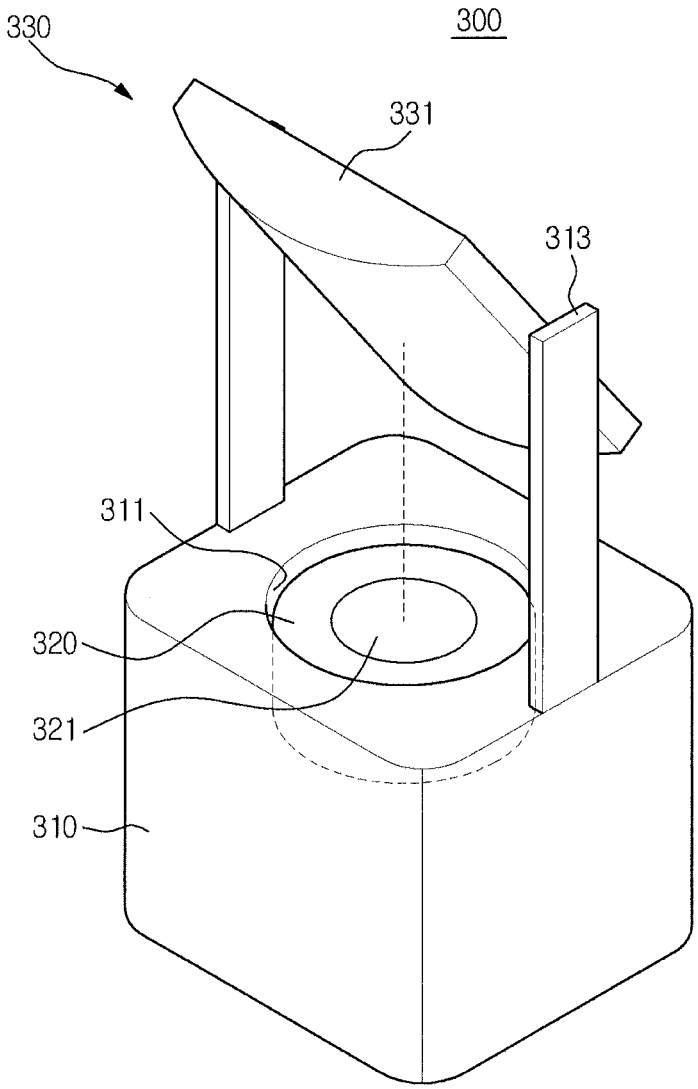
FIG. 9 is a perspective view illustrating an infrared ray detection device according to another embodiment.

FIG. 9 is a perspective view illustrating an infrared ray detection device according to another embodiment.

As shown in FIG. 9, the infrared ray detection device, which is designated by reference numeral "300", includes a housing 310, an infrared sensor 320, and a path change unit 330. The infrared sensor 320 is identical to the infrared sensor 120 shown in FIGS. 4 and 5.

The housing 310 defines an outer appearance of the infrared ray detection device 300. The housing 310 is formed with a sensor mounting portion 311, at which the infrared sensor 320 is mounted.

The housing 310 is also formed with support portions 313 extending upwardly from a top surface of the housing 310 to support the path change unit 330. In the illustrated embodiment, two support portions 313 are provided to support opposite sides of the path change unit 330, respectively. The path change unit 330 is fixedly mounted to the support portions 313, differently than in the previous embodiments.

The path change unit 330 is disposed on the path of an infrared ray passing through the detection hole 40*a* of the inner case ("40" in FIG. 3). The path change unit 330 reflects or refracts the infrared ray in order to change the path of the infrared ray.

The path change unit 330 may include a mirror having a predetermined curvature. That is, the path change unit 330 may be a curved mirror including a convex mirror or a concave mirror. The curved mirror may include a curved mirror having a spherical shape, a curved mirror having a non-spherical shape, and a cylindrical curved mirror. In this embodiment, a convex cylindrical mirror is used.

When a mirror having a curvature, different than a planar mirror, is used, infrared rays incident upon the mirror are converged, and then reflected toward the infrared sensor 320. Accordingly, it may be possible to sense the cooking chamber 20 over a wider region than the planar mirror.

Accordingly, it may be possible to enable the infrared sensor 320 to receive infrared rays generated throughout the entirety of the bottom surface of the cooking chamber 20, without requiring rotation of the path change unit 330.

The path change unit 330 is arranged such that a virtual axis, which extends upwardly from a center of a light receiving portion 321 included in the infrared sensor 320 while being perpendicular to the light receiving portion 321, passes through a region around a focus of a mirror 331 included in the path change unit 330. Infrared rays, which pass through the detection hole 40*a*, are reflected by the mirror 331 of the path change unit 330, and then converged at the light receiving portion 321.

The path change unit 330 is arranged to be spaced apart from the infrared sensor 320 by a certain distance.

Figure 10:
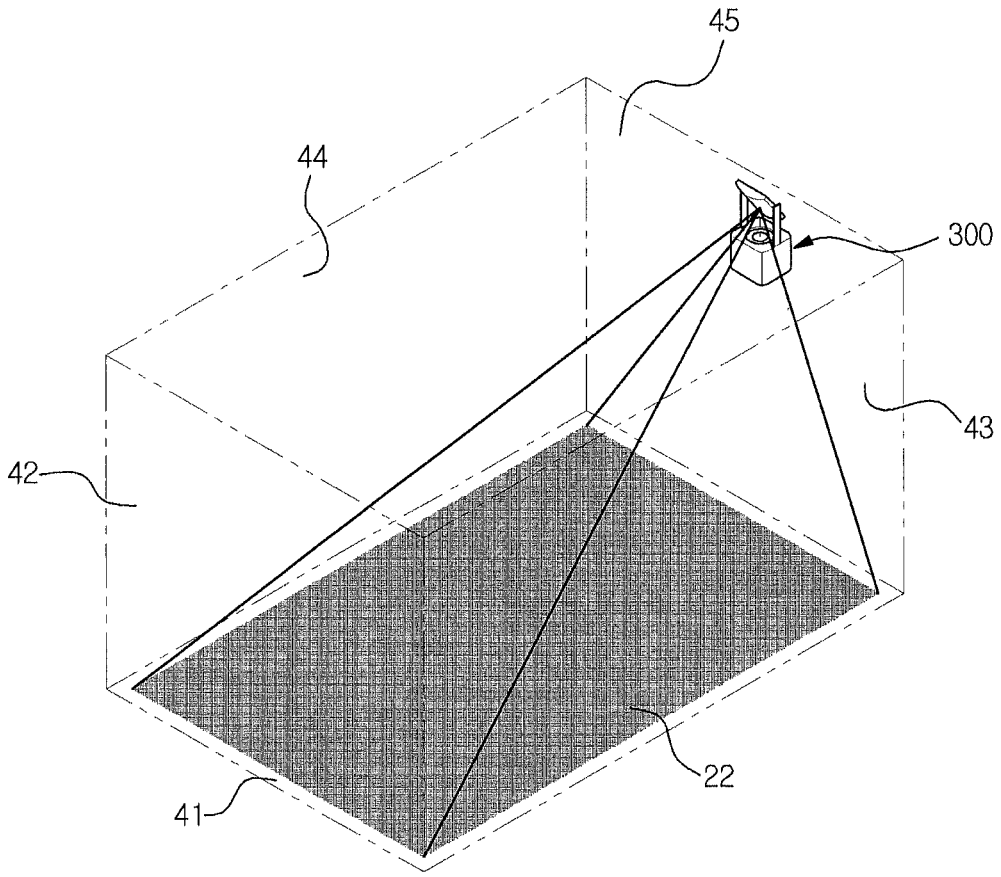
FIG. 10 is a view illustrating the detection range of the infrared ray detection device shown in FIG. 9.

FIG. 10 is a view illustrating the detection range of the infrared ray detection device shown in FIG. 9.

Referring to FIG. 10, when viewing the cooking chamber 20 from the side of the infrared ray detection device 300, the entirety of the bottom surface of the cooking chamber 20 is a detection region 22, from which the infrared ray detection device 300 can detect infrared rays.

Infrared rays generated in the detection region 22 are received by a plurality of infrared ray detection elements (not shown) disposed within the infrared sensor 320.

When infrared rays generated in the detection region 22 are received by the infrared sensor 320, the infrared sensor 320 measures the intensity of the received infrared rays. Based on the measured infrared ray intensity, it may be possible to calculate the temperature of the detection region 22. Thus, it may be possible to calculate the temperature distribution of the entirety of the bottom surface of the cooking chamber 20.

Figure 11:
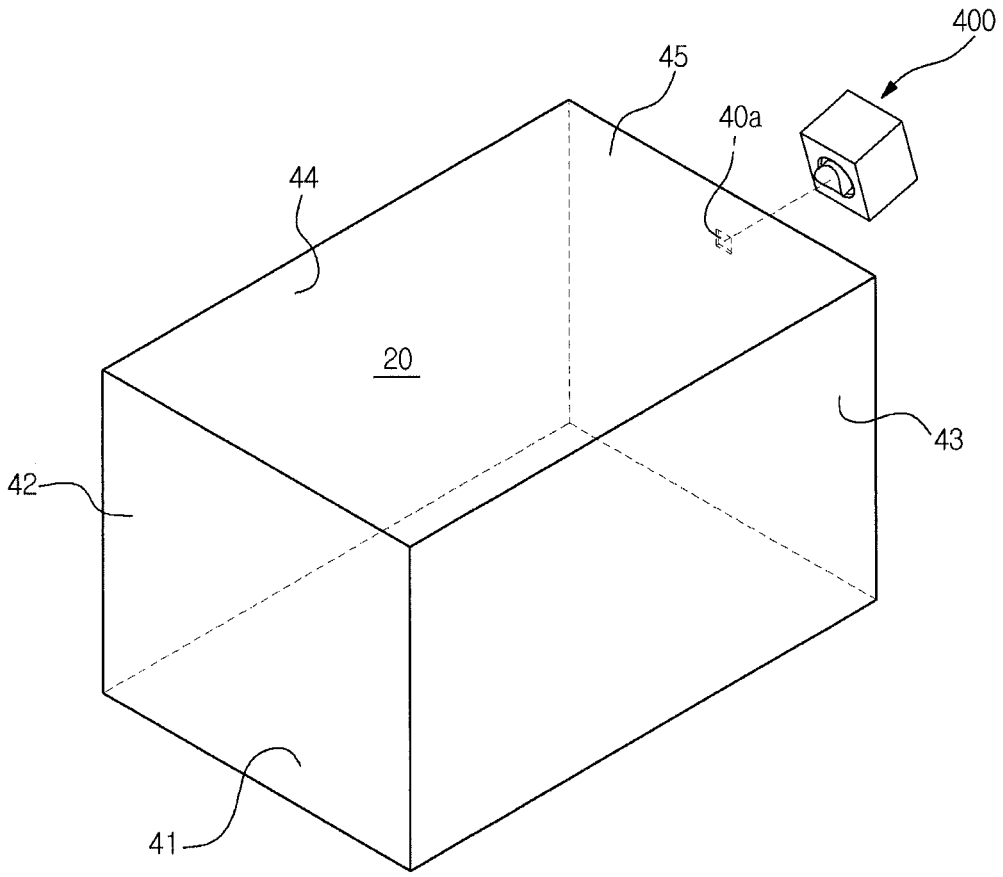
FIG. 11 is a view illustrating an infrared ray detection device mounted in a cooking chamber of a microwave oven according to another embodiment.
Figure 12:
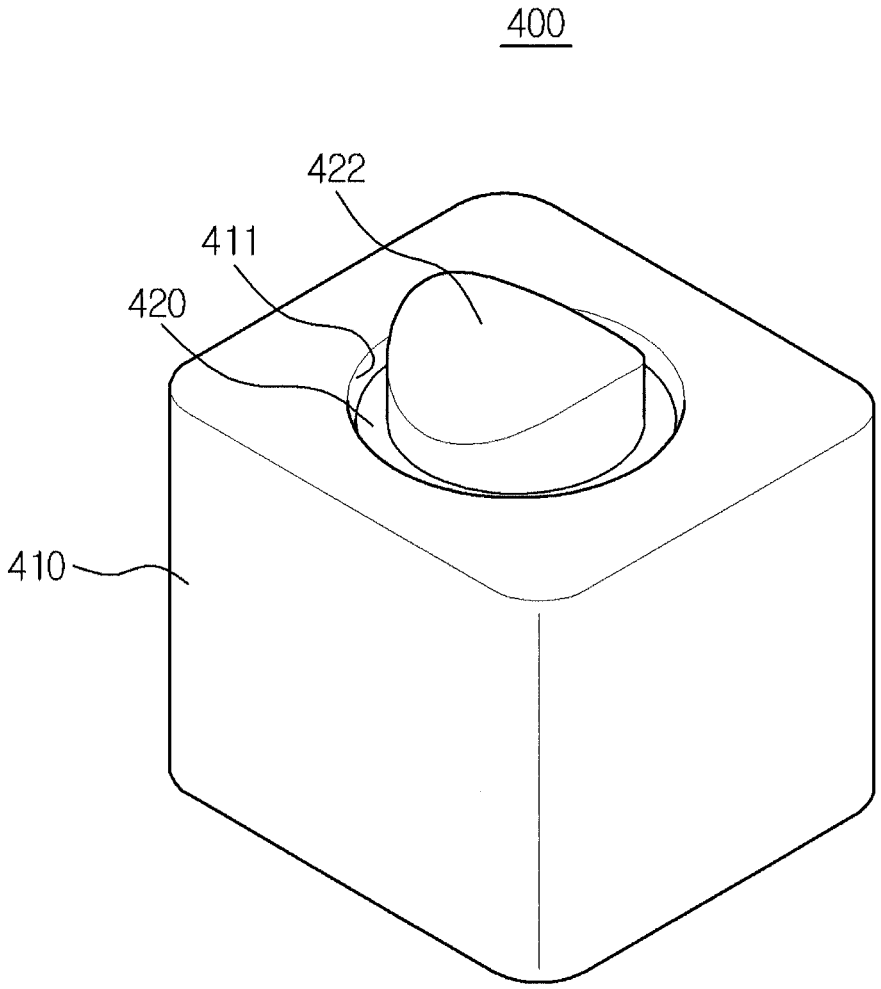
FIG. 12 is a perspective view illustrating the infrared ray detection device shown in FIG. 11.

FIG. 11 is a view illustrating an infrared ray detection device mounted in a cooking chamber of a microwave oven according to another. FIG. 12 is a perspective view illustrating the infrared ray detection device shown in FIG. 11.

As shown in FIGS. 11 and 12, the infrared ray detection device, which is designated by reference numeral "400", is disposed outside an inner case 40. A detection hole 40*a* is formed at a right wall 43 of the inner case 40, to allow an infrared ray generated in the cooking chamber 20 to exit outwardly from the cooking chamber 20.

Although the detection hole 40*a* is formed at the right wall 43 of the inner case 40 in the illustrated embodiment, it may be formed at a left wall 42 of the inner case 40. a rear wall 44 of the inner case 40, or a top wall 45 of the inner case 40.

When the detection hole 40*a* is formed at one of the left wall 42, right wall 43, and rear wall 44 of the inner case 40, it is positioned to be closer to the bottom wall 41 of the inner case 40, as described above in conjunction with the previous embodiments.

The infrared ray detection device 400 is disposed in the vicinity of the detection hole 40*a*, to receive infrared rays passing through the detection hole 40*a*.

The infrared ray detection device 400 is mounted to be inclined from the right wall 43 by a certain angle in order to allow infrared rays generated throughout the entirety of a lower portion of the cooking chamber 20 to be smoothly received by the infrared ray detection device 400 after passing through the detection hole 40*a*. That is, a light receiving portion (not shown) and a lens 422, which are included in the infrared ray detection device 400, are arranged to be directed to the bottom of the cooking chamber 20.

In addition to the lens 422, the infrared ray detection device 400 includes a housing 410 and an infrared ray sensor 420.

The housing 410 defines an outer appearance of the infrared ray detection device 400. The housing 410 is formed with a sensor mounting portion 411, at which the infrared sensor 420 is mounted.

The infrared sensor 420 has a cylindrical shape. The light receiving portion (not shown) is provided at a top surface of the infrared sensor 420, to receive infrared rays. The infrared sensor 420 is mounted to the sensor mounting portion 411 such that the light receiving portion (not shown) is directed upward.

The lens 422 is mounted to an outer surface of the light receiving portion (not shown) provided at the top surface of the infrared sensor 420. Infrared rays emerging from the detection hole 40*a* passes through the lens 422 so that they are received by the light receiving portion and infrared ray detection elements (not shown).

The lens 422 may be a lens having a curvature or a planar lens having no curvature. In particular, when the lens 422 is a lens having a curvature, it converges infrared rays emerging from the detection hole 40*a*. In this case, accordingly, it may be possible to sense the cooking chamber 20 over a wider region than the planar lens.

The lens, which has a curvature, may include a convex lens or a concave lens. The curved lens may include a spherical lens, a non-spherical lens, and a cylindrical lens in accordance with the shape thereof. In this embodiment, a concave cylindrical lens is used.

Figure 13:
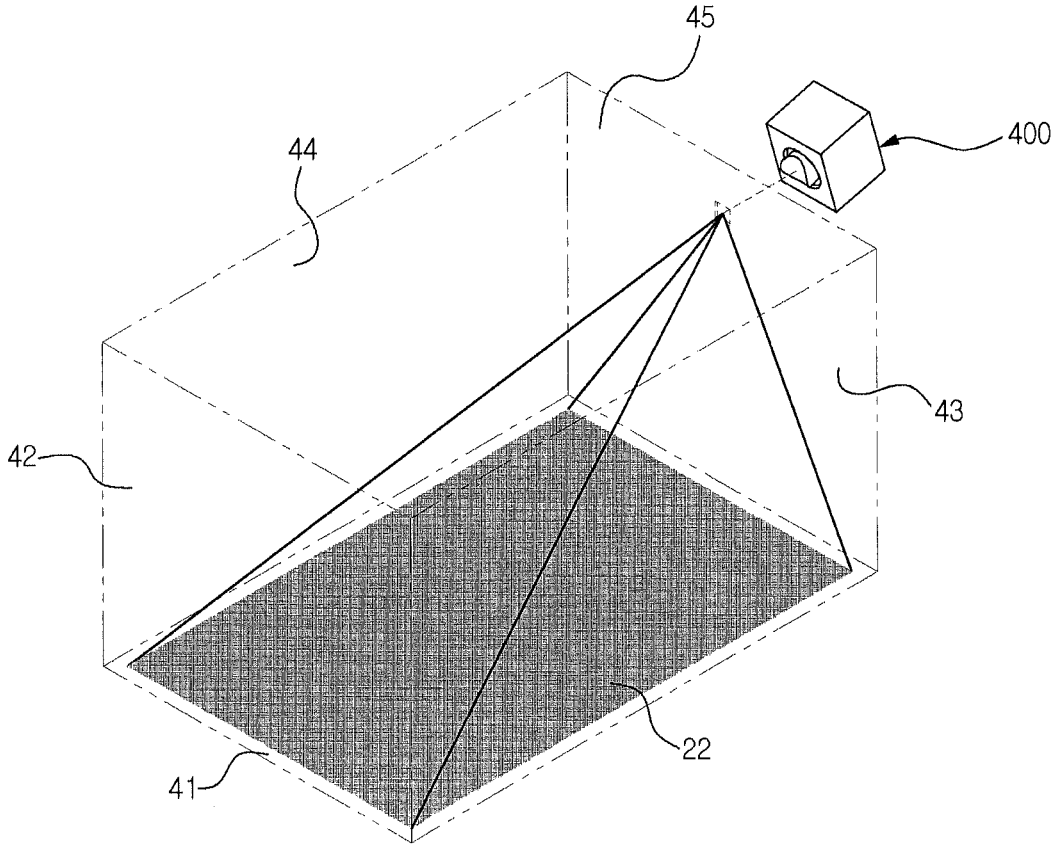
FIG. 13 is a view illustrating the detection range of the infrared ray detection device shown in of FIG. 11.

FIG. 13 is a view illustrating the detection range of the infrared ray detection device shown in FIG. 11.

Referring to FIG. 13, when viewing the cooking chamber 20 from the side of the infrared ray detection device 400, the entirety of the bottom surface of the cooking chamber 20 is a detection region 22, from which the infrared ray detection device 400 can detect infrared rays.

Infrared rays generated in the detection region 22 are received by a plurality of infrared ray detection elements (not shown) disposed within the infrared sensor 420 which, in turn, measures the intensity of the received infrared rays. Based on the measured infrared ray intensity, it may be possible to calculate the temperature of the detection region 22. Thus, it may be possible to calculate the temperature distribution of the entirety of the bottom surface of the cooking chamber 20.

Figure 14:
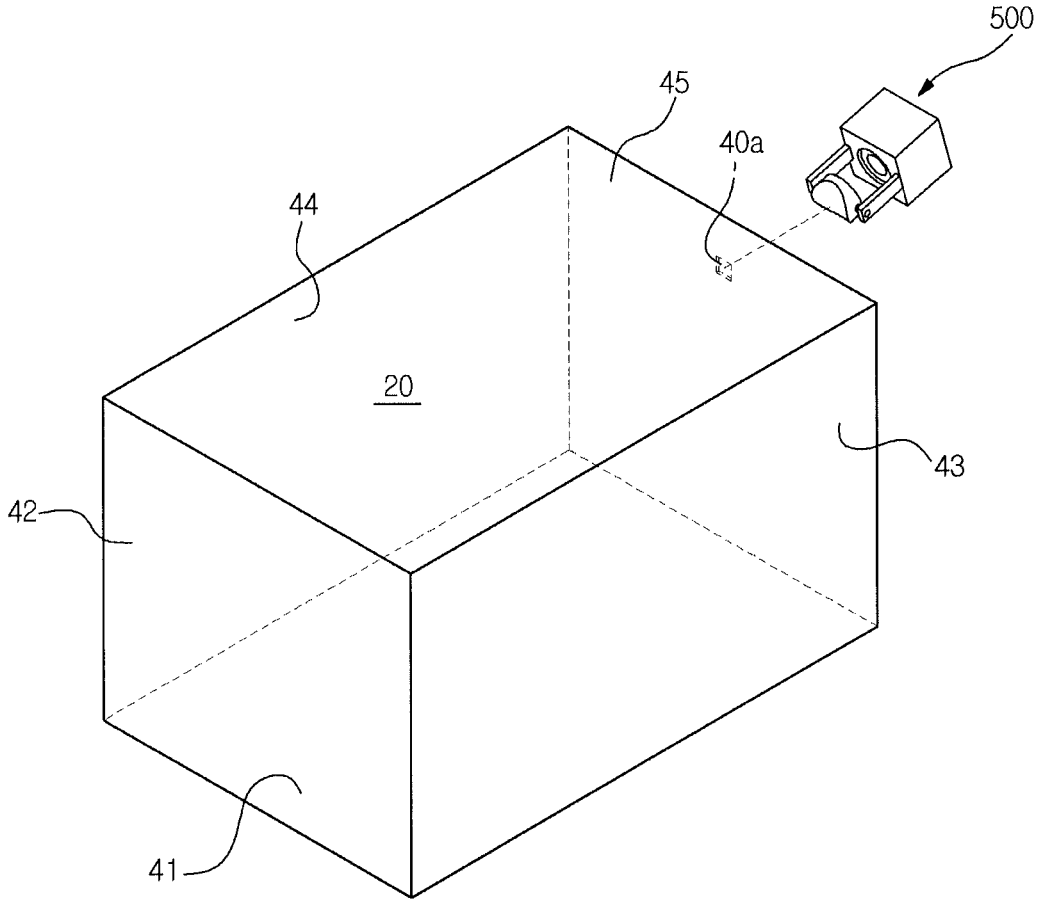
FIG. 14 is a view illustrating an infrared ray detection device mounted in a cooking chamber of a microwave oven according to another embodiment.
Figure 15:
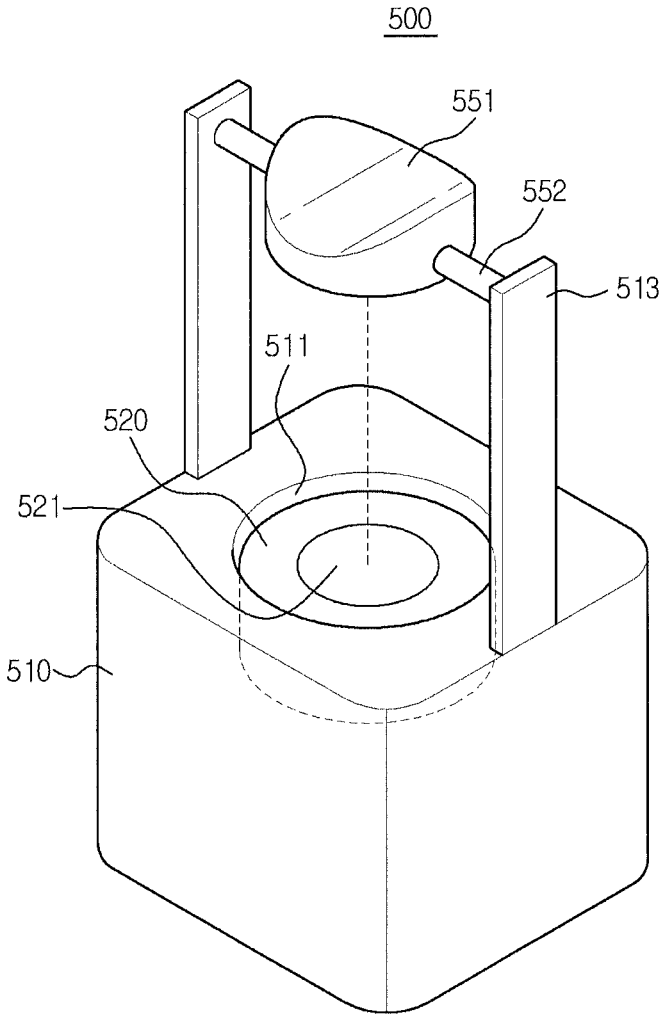
FIG. 15 is a perspective view illustrating the infrared ray detection device shown in FIG. 14.

FIG. 14 is a view illustrating an infrared ray detection device mounted in a cooking chamber of a microwave oven according to another. FIG. 15 is a perspective view illustrating the infrared ray detection device shown in FIG. 14.

As shown in FIGS. 14 and 15, the infrared ray detection device, which is designated by reference numeral "500", is disposed outside an inner case 40. A detection hole 40*a* is formed at a right wall 43 of the inner case 40, to allow an infrared ray generated in the cooking chamber 20 to exit outwardly from the cooking chamber 20.

The detection hole 40*a* may be formed at the right wall 43 of the inner case 40. In particular, the detection hole 40*a* may be formed to be closer to a top wall 45 of the inner case 40 than to a bottom wall 41 of the inner case 40.

The infrared ray detection device 500 is mounted to be inclined from the right wall 43 by a certain angle in order to allow infrared rays generated throughout the entirety of a lower portion of the cooking chamber 20 to be smoothly received by the infrared ray detection device 500 after passing through the detection hole 40*a*. That is, a light receiving portion 521 and a lens 522, which are included in the infrared ray detection device 500, are arranged to be directed to the bottom of the cooking chamber 20.

The infrared ray detection device 500 includes a housing 510 and an infrared sensor 520, in addition to the light receiving portion 521 and lens 551.

The housing 510 defines an outer appearance of the infrared ray detection device 500. The housing 510 is formed with a sensor mounting portion 511, at which the infrared sensor 520 is mounted, and support portions 513, to which the lens 551 is mounted.

The infrared sensor 520 has a cylindrical shape. The light receiving portion 521 is provided at a top surface of the infrared sensor 520, to receive infrared rays.

The infrared sensor 520 is mounted to the sensor mounting portion 511 such that the light receiving portion 521 is directed upward.

The support portions 513 extend upwardly from a top surface of the housing 510. In the illustrated embodiment, two support portions 513 are provided to support opposite sides of the lens 551, respectively.

The lens 551 is arranged to be spaced apart from the housing 510. A coupler 552 is interposed between each support portion 513 and the lens 551, to mount the lens 551 to the support portion 513. In the illustrated embodiment, two couplers 552 protrude from opposite lateral surfaces of the lens 551, respectively.

Although the couplers 552 are provided in the illustrated embodiment, the lens may be directly fixed to the support portions 513 without using the couplers 552.

The lens 551 may be a lens having a curvature or a planar lens having no curvature. In particular, when the lens 551 is a lens having a curvature, it converges infrared rays emerging from the detection hole 40*a*. In this case, accordingly, it may be possible to sense the cooking chamber 20 over a wider region than the planar lens.

The lens, which has a curvature, may include a convex lens or a concave lens. The curved lens may include a spherical lens, a non-spherical lens, and a cylindrical lens in accordance with the shape thereof. In this embodiment, a convex cylindrical lens is used.

Infrared rays incident upon the lens 551 through the detection hole 40*a* are converged at a focus of the lens 551, and then received by the light receiving portion 521.

Figure 16:
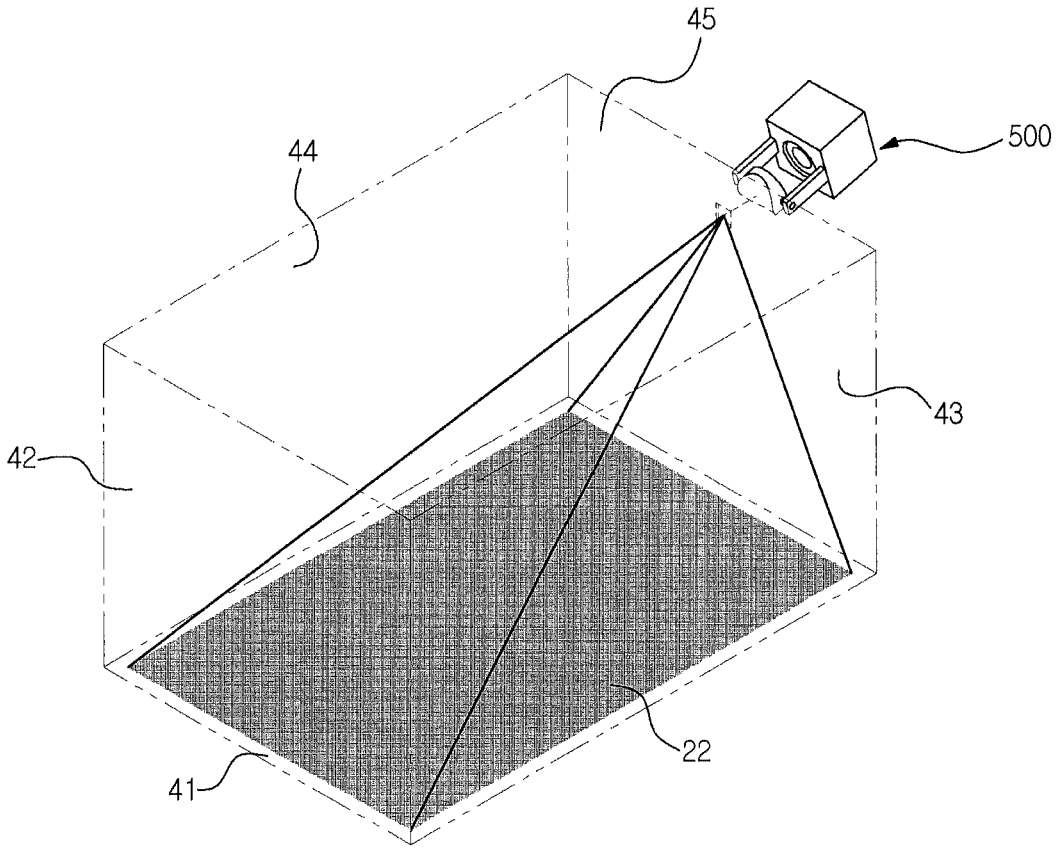
FIG. 16 is a view illustrating the detection range of the infrared ray detection device shown in FIG. 15.

FIG. 16 is a view illustrating the detection range of the infrared ray detection device shown in FIG. 15.

Referring to FIG. 16, the entirety of the bottom surface of the cooking chamber 20 is a detection region 22, from which the infrared ray detection device 500 can detect infrared rays. The infrared ray detection device 500 measures the intensity of infrared rays, to calculate the temperature of the entirety of the bottom surface of the cooking chamber 20 based on the measured infrared ray intensity.

In the above-described embodiments, the infrared ray detection devices, which have a mirror having a curvature or a lens having a curvature, have been described as not including a driver to rotate the mirror or lens. However, even such an infrared ray detection device, which includes a mirror having a curvature or a lens having a curvature, may include a driver to rotate the mirror or lens in order to achieve more accurate measurement of the temperature of the bottom surface of the cooking chamber 20.

The above-described heating cooker may receive infrared rays generated from food without being exposed to the cooking chamber. Accordingly, it may be possible to prevent the light receiving portion of the infrared sensor from being contaminated by oil vapor or water vapor generated during cooking. It may also be possible to reduce an interference phenomenon caused by microwaves.

Since the path change unit is rotatable, the infrared sensor may receive infrared rays generated in a plurality of regions on the bottom surface of the cooking chamber, on which food is placed, in particular, the entirety of the bottom surface. Accordingly, it may be possible not only to measure the temperature of food, but also to acquire information about the position at which the food is placed. The information may be utilized in cooking of the food.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A heating cooker comprising:

a body;

an inner case disposed within the body, and provided therein with a cooking chamber to cook food;

a detection hole formed at one side wall of the inner case, to allow an infrared ray generated in the cooking chamber to exit outwardly from the cooking chamber;

a path change unit disposed in the vicinity of the detection hole, to change a path of the infrared ray passing through the detection hole; and an infrared sensor disposed to be spaced apart from the path change unit, to receive the infrared ray, the path of which has been changed, wherein the path change unit is rotatable to enable the infrared sensor to receive infrared rays having different paths while being generated in different regions in the cooking chamber, wherein the infrared sensor comprises a light receiving portion to receive an infrared ray, and wherein the light receiving portion is not positioned on the path of the infrared rays emerging from the detection hole.

2. The heating cooker according to claim 1, wherein a distance, by which the infrared sensor is spaced apart from the path change unit, is kept constant during rotation of the path change unit.

3. The heating cooker according to claim 1, wherein the detection hole is formed at one of left and right side walls of the inner case, and is disposed closer to a top wall of the inner case than to the bottom wall of the inner case.

4. The heating cooker according to claim 1, wherein the path change unit comprises a mirror to reflect an infrared ray, thereby changing a path of the infrared ray.

5. The heating cooker according to claim 1, further comprising a driver connected to the path change unit, to rotate the path change unit.

6. The heating cooker according to claim 5, wherein the driver comprises a stepper motor to rotate the path change unit stepwise by a predetermined angle.

7. The heating cooker according to claim 1, wherein a distance, by which the infrared sensor is spaced apart from the path change unit, is 20 mm or less.

8. The heating cooker according to claim 1, wherein:

the light receiving portion disposed to face the path change unit, to receive an infrared ray; and the path change unit rotates about a virtual rotation axis perpendicular to the light receiving portion.

9. The heating cooker according to claim 8, wherein, infrared rays generated in regions between opposite edges of a bottom surface of the cooking chamber are received by the infrared sensor during rotation of the path change unit.

10. The heating cooker according to claim 1, wherein:

the light receiving portion disposed to face the path change unit, to receive an infrared ray; and the path change unit rotates about a rotation axis perpendicular to a virtual axis, which is perpendicular to the light receiving portion.

11. An infrared ray detection device comprising:

a path change unit to change a path of an infrared ray; and an infrared sensor disposed to be spaced apart from the path change unit, to receive the infrared ray, the path of which has been changed, wherein the path change unit is rotatable to enable the infrared sensor to receive infrared rays having different paths, wherein the infrared sensor comprises a light receiving portion to receive an infrared ray, and wherein the light receiving portion is not positioned on the path of the infrared rays emerging from the detection hole.

12. The infrared ray detection device according to claim 11, wherein a distance, by which the infrared sensor is spaced apart from the path change unit, is kept constant during rotation of the path change unit.

13. The infrared ray detection device according to claim 11, wherein a distance, by which the infrared sensor is spaced apart from the path change unit, is 20 mm or less.

14. The infrared ray detection device according to claim 11, wherein:

the light receiving portion disposed to face the path change unit; and the path change unit rotates about a virtual axis perpendicular to the light receiving portion.

15. The infrared ray detection device according to claim 11, wherein:

the light receiving portion disposed to face the path change unit, to receive an infrared ray; and the path change unit rotates about a rotation axis perpendicular to a virtual axis, which is perpendicular to the light receiving portion while passing though the light receiving portion.

16. A heating cooker comprising:

a body;

an inner case disposed within the body, and provided therein with a cooking chamber to cook food;

a detection hole formed at one side wall of the inner case, to allow an infrared ray generated in the cooking chamber to exit outwardly from the cooking chamber;

a path change unit disposed in the vicinity of the detection hole, to change a path of the infrared ray passing through the detection hole; and an infrared sensor disposed to be spaced apart from the path change unit, to receive the infrared ray, the path of which has been changed, wherein the path change unit is rotatable to enable the infrared sensor to receive infrared rays having different paths while being generated in different regions in the cooking chamber, wherein the path change unit rotates about a virtual rotation axis perpendicular to the light receiving portion, wherein the infrared sensor comprises a light receiving portion to receive an infrared ray, and wherein the light receiving portion is not positioned on the path of the infrared rays emerging from the detection hole.

17. A method for measuring a cooking chamber temperature in a heating cooker including a cooking chamber, a path change unit disposed outside the cooking chamber, the path change unit being rotatable to change a path of an infrared ray generated in the cooking chamber, and an infrared sensor to receive the infrared ray, the path of which has been changed, comprising:

rotating the path change unit to a first position, to enable the infrared sensor to receive infrared rays generated in a first region on a bottom surface of the cooking chamber;

rotating the path change unit to a second position, to enable the infrared sensor to receive infrared rays generated in a second region on the bottom surface of the cooking chamber;

measuring intensities of the infrared rays received by the infrared sensor after being generated in the first and second regions; and calculating temperatures of the first and second regions, based on the measured infrared ray intensities.

18. A heating cooker comprising:

a body;

an inner case disposed within the body, and provided therein with a cooking chamber to cook food;

a detection hole formed at one side wall of the inner case, to allow an infrared ray generated in the cooking chamber to exit outwardly from the cooking chamber;

an infrared sensor to detect an infrared ray, thereby measuring an internal temperature of the cooking chamber; and a path change unit disposed in the vicinity of the detection hole, to change a path of the infrared ray passing through the detection hole, thereby causing the infrared ray to be directed to the infrared sensor;

wherein the path change unit comprises a mirror having a curvature to enable the infrared sensor to detect the infrared ray generated in the cooking chamber.

19. The heating cooker according to claim 18, wherein the mirror is a convex mirror.

20. The heating cooker according to claim 18, wherein the mirror is a concave mirror.

21. A heating cooker comprising:

a body;

an inner case disposed within the body, and provided therein with a cooking chamber to cook food;

a detection hole formed at one side wall of the inner case, to allow an infrared ray generated in the cooking chamber to exit outwardly from the cooking chamber;

an infrared sensor to detect an infrared ray, thereby measuring an internal temperature of the cooking chamber; and an infrared ray convergence unit disposed in the vicinity of the detection hole, the infrared ray convergence unit having a curvature to cause the infrared ray generated in the cooking chamber to be converged toward the infrared sensor.

22. The heating cooker according to claim 21, wherein the infrared ray convergence unit comprises a lens having a curvature.

23. The heating cooker according to claim 22, wherein the lens comprises a convex lens.

24. The heating cooker according to claim 22, wherein the lens comprises a concave lens.

25. The heating cooker according to claim 22, wherein the infrared sensor comprises a light receiving portion disposed in parallel to the lens to receive an infrared ray.

26. The heating cooker according to claim 25, wherein the lens and the light receiving portion are disposed to be inclined with respect to one of left and right walls of the inner case where the detection hole is formed.

27. The heating cooker according to claim 22, wherein the lens and the infrared sensor are integrally formed.

28. The heating cooker according to claim 22, wherein:

the infrared sensor comprises a light receiving portion to receive an infrared ray; and the lens is mounted to an outer surface of the light receiving portion.

29. The heating cooker according to claim 21, wherein the infrared ray convergence unit comprises a mirror having a curvature.

30. The heater cooker according to claim 4, wherein the mirror is selected to be either a planar mirror or a curved mirror.

31. The infrared detection device according to claim 11, wherein the path change unit is selected to be either planar reflecting mirror or a curved reflecting mirror.

32. The infrared detection device according to claim 11, further comprising a drive device connected to the path change unit to move the path charge unit.

* * * * *

UNITED STATES PATENT AND TRADEMARK OFFICE

CERTIFICATE OF CORRECTION

PATENT NO. : 9,173,254 B2
APPLICATION NO. : 13/289520
DATED : October 27, 2015
INVENTOR(S) : Jun hoe Choi et al.

It is certified that error appears in the above-identified patent and that said Letters Patent is hereby corrected as shown below:

IN THE CLAIMS

Claim 30, Column 16, Line 56

Delete “heater” and insert --heating--, therefor.

Signed and Sealed this
Second Day of February, 2016

Michelle K. Lee

Michelle K. Lee
*Director of the United States Patent and Trademark Office*